US010329901B2

(12) United States Patent
Switzer et al.

(10) Patent No.: US 10,329,901 B2
(45) Date of Patent: Jun. 25, 2019

(54) SURFACE DISPLAY INTERFACE FOR DATA FROM DOWNHOLE SYSTEMS

(71) Applicant: EVOLUTION ENGINEERING INC., Calgary (CA)

(72) Inventors: David A. Switzer, Calgary (CA); Sheng Xu, Calgary (CA); Aaron W. Logan, Calgary (CA); Anquan Men, Calgary (CA); Kurtis K. L. West, Calgary (CA); Barry D. Buternowsky, Calgary (CA); Angelica J. B. Francoeur, Calgary (CA); Grant E. Harding, Calgary (CA); Gilles A. Pelletier, Golden (CA); Sabrina M. Huston, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 15/852,415

(22) Filed: Dec. 22, 2017

(65) Prior Publication Data

US 2018/0179888 A1 Jun. 28, 2018

Related U.S. Application Data

(60) Provisional application No. 62/439,881, filed on Dec. 28, 2016.

(51) Int. Cl.

| | |
|---|---|
| ***G01V 3/00*** | (2006.01) |
| ***E21B 47/12*** | (2012.01) |
| *E21B 47/18* | (2012.01) |
| *E21B 47/00* | (2012.01) |

(52) U.S. Cl.
CPC ..... *E21B 47/122* (2013.01); *E21B 47/121* (2013.01); *E21B 47/00* (2013.01); *E21B 47/18* (2013.01)

(58) Field of Classification Search
CPC ..... E21B 47/122; E21B 47/121; E21B 47/00; E21B 47/18
USPC ..... 340/854.6
See application file for complete search history.

(56) References Cited

U.S. PATENT DOCUMENTS

2015/0134390 A1* 5/2015 Hildebrand ..... G06Q 10/06314 705/7.15
2017/0194784 A1* 7/2017 Alaas ..... E21B 47/12

* cited by examiner

*Primary Examiner* — Tanmay K Shah
(74) *Attorney, Agent, or Firm* — Oyen Wiggs Green & Mutala LLP

(57) ABSTRACT

A telemetry system useful in drilling operations receives and displays telemetry data. The telemetry system also determines and displays information regarding the status of the telemetry transmission. The telemetry system may display which data will be updated next, when the update is expected to be complete, and how reliable is the currently displayed data. The system can facilitate efficient drilling operations.

24 Claims, 6 Drawing Sheets

30

SURFACE DISPLAY INTERFACE FOR DATA FROM DOWNHOLE SYSTEMS

CROSS-REFERENCE TO RELATED APPLICATIONS

This application claims the benefit under 35 U.S.C. § 119 of U.S. application No. 62/439,881 filed 28 Dec. 2016 and entitled SURFACE DISPLAY INTERFACE FOR DATA FROM DOWNHOLE SYSTEMS which is hereby incorporated herein by reference for all purposes.

TECHNICAL FIELD

This application relates to subsurface drilling, specifically, to uplink telemetry of information from downhole apparatus. Embodiments provide methods and apparatus useful for directional drilling and measurement while drilling operations. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles, or fields for detection by other devices; interfacing to other downhole equipment; sampling downhole fluids; etc.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe. Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. The electrical power available to generate EM signals may be provided by batteries or another power source that has limited capacity.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals attenuate faster than low frequency signals.) The electromagnetic signals may be detected at the surface, for example by measuring electrical potential differences between the drill string or a metal casing that extends into the ground and one or more ground rods.

One difficulty faced by operators of downhole telemetry equipment is that downhole telemetry can be very slow. Even EM telemetry, which is faster than many other telemetry methods, may take several seconds to transmit a single piece of data to the surface. Operating a drill rig is very expensive. Consequently, it is highly desirable to operate the drill rig efficiently. This includes acting immediately when new data is received by telemetry. However, the "hurry up and wait" rhythm that is imposed by the fact that telemetry is sometimes very slow interferes with the ability of humans to act in the most efficient manner. There is a need for systems which facilitate more efficient drilling operations. There is a particular need for telemetry systems adapted to more effectively communicate telemetry information to human operators so that such information can be acted on efficiently.

SUMMARY

The invention has a number of different aspects. These include, without limitation, apparatus for displaying data received from downhole systems, methods for displaying data received from downhole systems, methods for determining and indicating the reliability of data received from downhole systems, methods for indicating when displayed data is to be updated, and methods and apparatus useful for assessing reliability of apparatus. Different aspects of the invention may be applied individually or in any combinations.

One example aspect provides a method for displaying data from downhole systems. The method may comprise receiving data at a surface unit determining a downhole tool operating mode, determining a plurality of display fields to be displayed based at least in part on the downhole tool operating mode, displaying the received data in at least some of the plurality of display fields, and displaying a next data indicator for one or more of the display fields to indicate when the corresponding display field will next be updated.

In some aspects of the method for displaying data from downhole systems, the next data indicator comprises a countdown timer indicating when a corresponding display field will next be updated. In some aspects of the method, the countdown timer is set based at least in part on a rate at which the received data is received.

In some aspects of the method for displaying data from downhole systems, the method comprises displaying a reliability indicator corresponding to at least one of the display fields.

Another example aspect comprises a surface unit for displaying data received from a downhole system. The surface unit may comprise a receiver for receiving downhole data, and a display for displaying the downhole data. The received downhole data may be displayed in one or more display fields. One or more indicators, corresponding to the one or more display fields, may indicate when the display fields will next be updated.

Another example aspect provides a method for assessing the risk that a downhole apparatus may fail. The method may comprise receiving data at a surface unit to generate a failure risk for the downhole apparatus, displaying the failure risk on the surface unit, and displaying a warning on the surface unit when the failure risk exceeds a threshold, wherein the data comprises at least one of: information on the downhole apparatus, information on a borehole the downhole apparatus is within, information on an environment the downhole apparatus is within, information on past outcomes of a similar downhole apparatus, and information on a performance of the downhole apparatus.

In some aspects of the method for assessing the risk that a downhole apparatus may fail, the failure risk comprises a probability that the downhole apparatus will fail within a particular time period.

In some aspects of the method for assessing the risk that a downhole apparatus may fail, the downhole apparatus comprises a plurality of subassemblies, and the data comprises information on at least one of the plurality of subassemblies. Some aspects of the method comprise replacing at least one of the subassemblies based at least in part on the failure risk for the at least one of the subassemblies.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
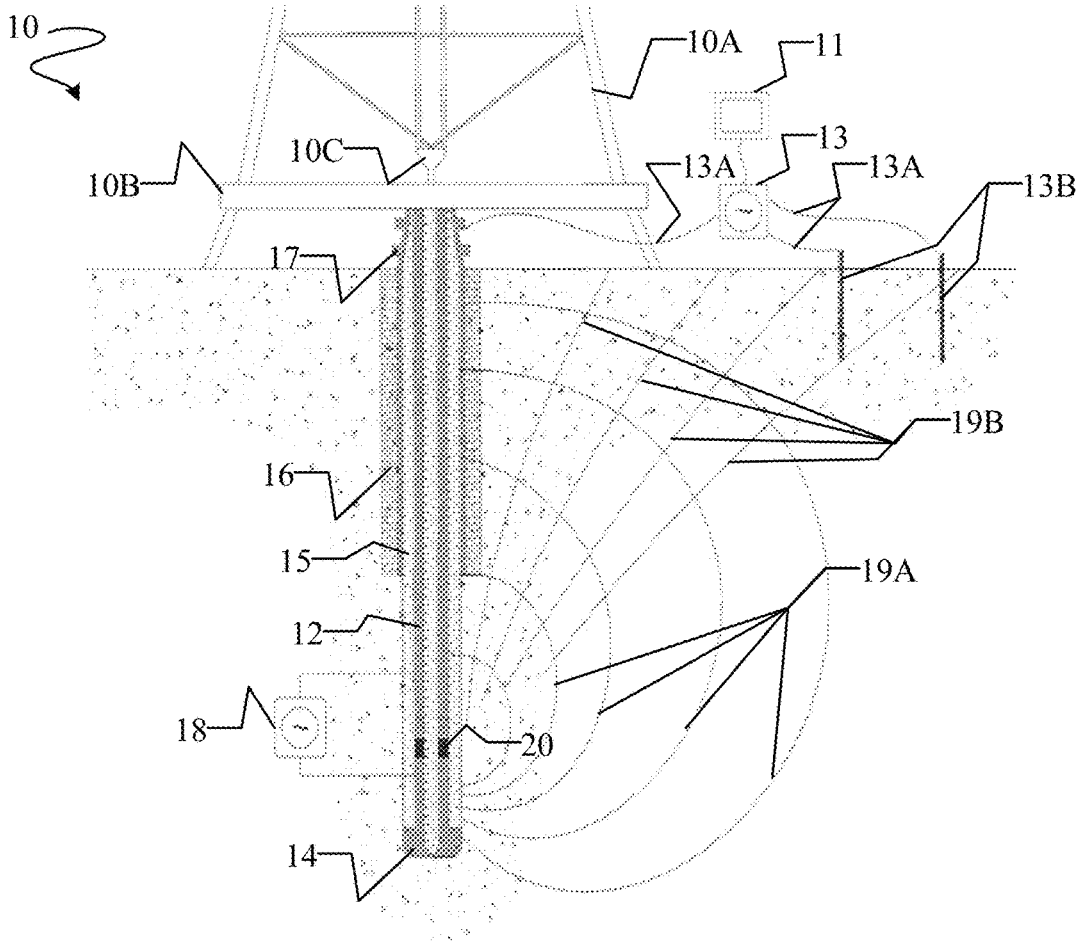
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B, and draw works 10C for supporting the drill string. Drill bit 14 is larger in diameter than the drill string above drill bit 14. An annular region 15 surrounding drill string 12 is typically filled with drilling fluid. The drilling fluid is pumped through a bore in drill string 12 to drill bit 14 and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

A gap sub 20 may be positioned, for example, at the top of the BHA. Gap sub 20 divides drill string 12 into two electrically-conductive parts that are electrically insulated from one another. The two parts form a dipole antenna structure. For example, one part of the dipole may be made of the BHA up to the electrically insulating gap and the other part of the dipole may be made up of the part of drill string 12 extending from the gap to the surface.

A very low frequency alternating current (AC) electrical signal is generated by an EM telemetry signal generator 18 at a downhole tool and applied across gap sub 20. The low frequency AC signal energizes the earth and creates an electromagnetic field 19 which results in a measurable voltage differential between the top of drill string 12 and one or more grounded electrodes 13B (such as ground rods or ground plates). The electrical signal is varied in a way which encodes information for transmission by telemetry. Conductors 13A carry the signal to a detector 13 that is connected to deliver the signal to surface equipment 11. Surface equipment 11 may decode and display data carried by the signal.

One aspect of this invention relates to a user interface for a surface telemetry receiver. The user interface provides users with information regarding the status of telemetry transmissions. This information allows users to better prepare themselves to take action in a timely fashion when telemetry information has been received.

Prior art displays for a surface telemetry receiver may comprise a display having a set of fields for displaying tool face information (direction and inclination). As the telemetry receiver receives new values for the tool face information by uplink telemetry from a downhole tool, the new values are displayed on the display. To ensure that drilling is controlled using the most up-to-date information, a user must watch the display until the values are updated and then promptly make any appropriate changes to the operation of the drilling equipment. In some cases, for example where the drilling is proceeding at a deep location, updates to the tool face information may be received as infrequently as once every few minutes. If an operator misses noticing that the display has been refreshed with new tool face information, the operator may have to wait for up to several minutes to make sure that they are acting on the most current information.

Figure 2:
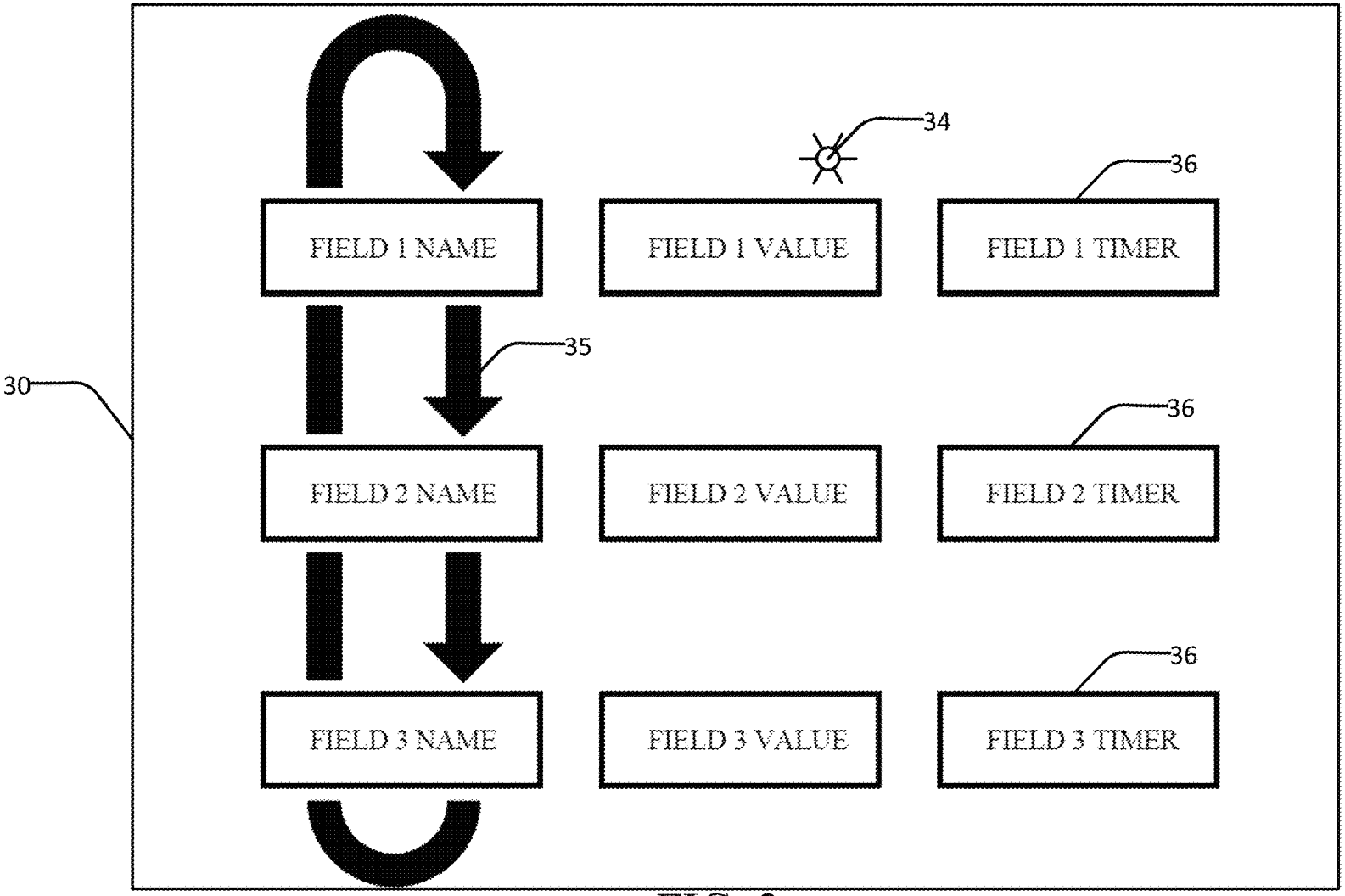
FIG. 2 shows a schematic depiction of a display according to an example embodiment of the invention.

FIG. 2 shows a display 30 according to an example embodiment of the invention. Display 30 displays various items of data that have been received at a surface telemetry receiver by uplink telemetry from a downhole tool. One feature of display 30 is an indicator 34 that indicates the next item of data that is scheduled to be transmitted from the downhole tool. By viewing which data is indicated by indicator 34, a user can determine exactly where the downhole tool is in its cycle of transmitting data.

Indicator 34 may comprise any visible indication that makes a selected data field stand out. Possible indicators include any one or more of:

- a lamp or indicia displayed near a field;
- highlighting and/or a border applied to a field;
- enhanced brightness of a field;
- colour applied to a field;
- a different font applied to a field;
- flashing colour change or another temporally varying pattern applied to a field;
- etc.

In the illustrated embodiment, display 30 also displays a text or graphic illustration 35 showing the complete cycle (e.g. transmission frame) of data which the downhole tool is currently scheduled to transmit. The scheduled cycle may depend on the status of a drilling operation and/or on a mode of data collection. Data may be transmitted in frames which are structured to provide a certain sequence of items of data formatted in a predetermined manner. Examples of frames include sliding frames (transmitted while the drill string is not being rotated from the surface), survey frames (which contain information from downhole sensor readings), rotating frames (transmitted when the drill string is being rotated from the surface), and status frames (which report on the status of one or more downhole tools). A survey frame typically contains the highest priority data such as inclination, azimuth, and sensor qualification/verification. The sliding frame typically includes toolface readings and may also include additional data sent between successive toolface messages such as gamma readings. The rotating frame typically does not include toolface readings as such readings are not generally necessary when the drill string is being rotated at the surface. Any other measurement data can also be included in the rotating frame. A status frame can include data that is useful to alert the surface operator of a change in the telemetry type, speed, amplitude, configuration change, significant sensor change (such as a non-functioning or reduced-functioning accelerometer), or other changes that would be important and/or of interest to the operator. The status frame may include an identifier which indicates how uplink data has been formatted/encoded. This identifier may be used by surface receiving and processing equipment to select the correct demodulation and other decoding operations to decode signals received at surface.

In some embodiments, display 30 includes timers 36 which indicate the expected time at which one or more specific data fields are expected to be next updated. Timers 36 may be countdown timers. Such countdown timers may be controlled based on a current rate at which data is being received from the downhole tool taken together with the amount of data yet to be received before the field(s) in question will be updated.

Display 30 may optionally include count-up timers which indicate how long it has been since the currently displayed data was last updated.

Timers 36 may be implemented in various ways. In some embodiments, each timer calculates and records a time at which a data field is expected to be updated and then periodically compares the executed completion time to a current time. The expected completion time may optionally be updated one or more times before the expected completion time.

Figure 3:
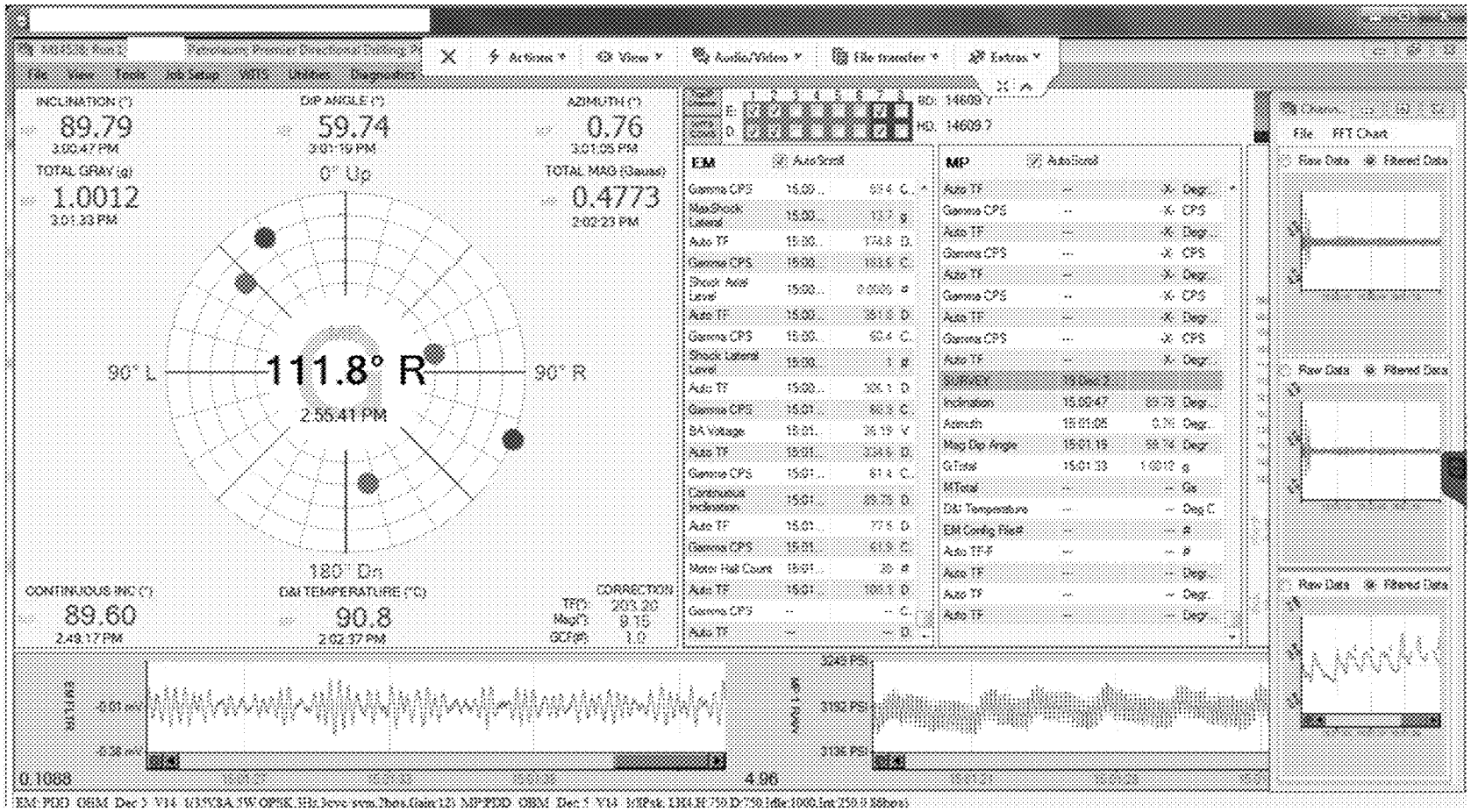
FIG. 3 shows an example display.

FIG. 3 shows an example display 30. In some embodiments, display 30 is configurable amongst a number of modes which are each optimized to display information required for specific types of drilling operation in a way which is most convenient for the user.

In some embodiments, display 30 includes an indicator that is activated to confirm that uplink telemetry data is being received. Display 30 may also include one or more indications as to how fast the uplink telemetry data is being received (e.g. a display which indicates a transmit time per bit or other data reception rate). Display 30 may also include one or more indications relating to other characteristics of the uplink telemetry, such as frequency, voltage, cycles per bit, gain, phase-key shifting, etc.

Figure 4:
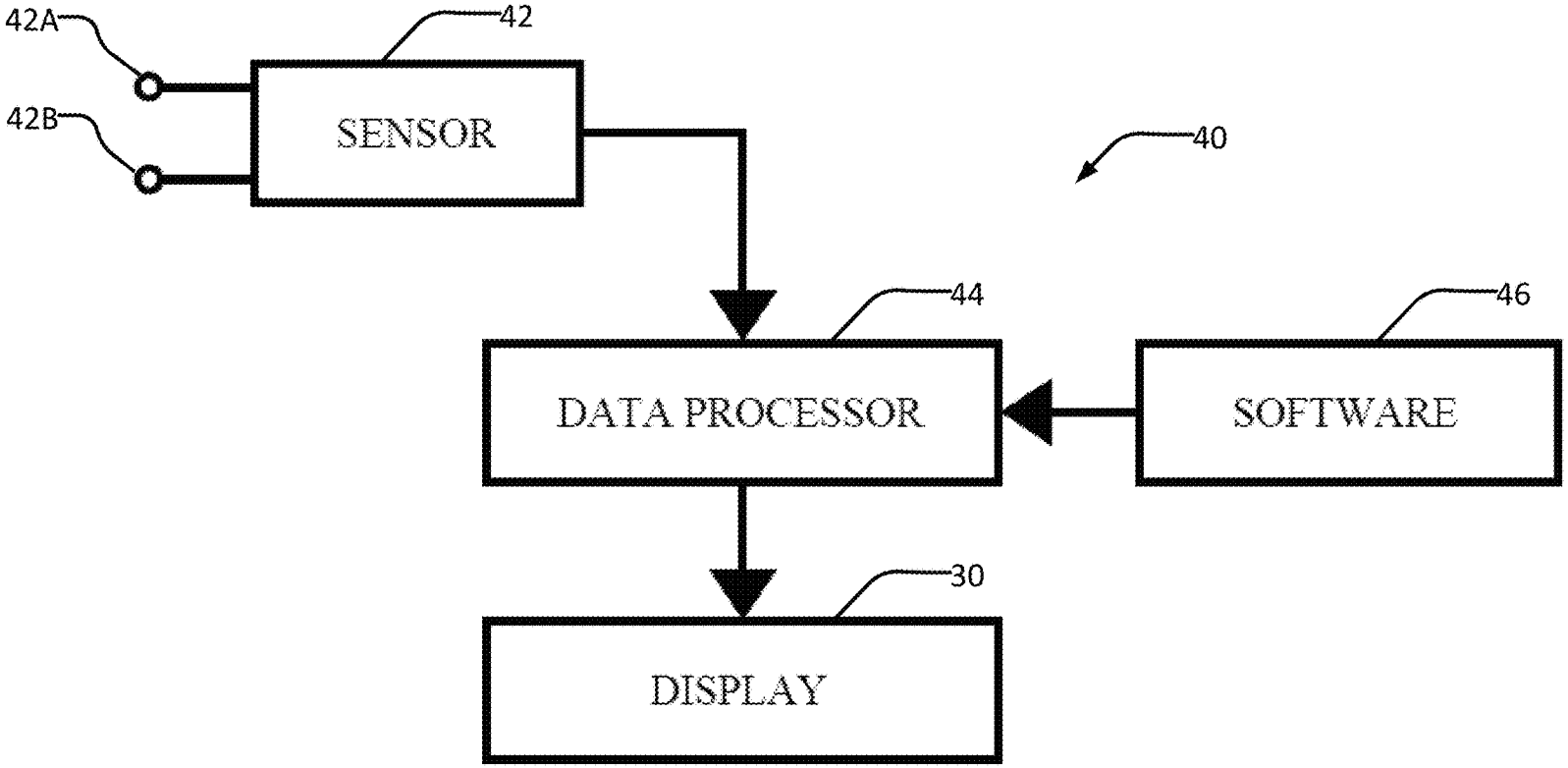
FIG. 4 is a block diagram of an example surface telemetry receiver.

FIG. 4 illustrates a surface telemetry receiver 40 including a display 30. Receiver 40 includes a telemetry signal sensor 42. Telemetry signal sensor 42 has inputs 42A and 42B that may, respectively, be connected to an uphole end of a drill string and one or more ground rods. Sensor 42 detects an electrical potential difference between the inputs 42A and 42B. This potential difference changes in response to uplink telemetry signals generated by a downhole tool. Sensor 42 may, for example, include analog signal amplification and conditioning circuits. These circuits may include filters which filter out frequencies which are not part of the expected uplink telemetry signals. Signal detector 42 may also include an analog-to-digital converter which converts the received signals to a series of digital samples. The series of digital samples which make up the signal may then be further processed in the digital domain by a data processor 44. For example, digital filters may be applied to the signals. The signals are further processed to extract encoded data. The encoded data is then displayed in appropriate fields of display 30. Extracting the encoded data is performed in a way that depends on how the data is encoded. For example, the data may be encoded using schemes such as binary phase-shift keying (BPSK).

In some embodiments, data processor 44 processes received EM telemetry signals to establish a frequency of these signals. For example, the frequency may be in the range of ¼ Hz to 20 Hz. This frequency may be determined either using prior knowledge of a mode according to which the downhole telemetry transmitter is operating, by processing received telemetry signals, or may be defined by an operator using controls of surface equipment to set parameters used by telemetry and surface software to receive and/or decode received telemetry signals. In some embodiments, the parameters include frequency and/or cycles per bit (cycles/bit).

Processing may comprise, for example, performing a Fourier transform or equivalent. This information is combined with other information about the encoding scheme such as: the number of cycles/bit; the number of bits received so far in a current frame of data; and the number of bits still to be received before the data in question will be available. For example, in a case where a data unit is 10 bits, an EM telemetry signal is operating at a frequency of 1 Hz, the encoding scheme being used takes 2 cycles/bit, and 7 bits of data remain to be transmitted, receiver 40 may compute a time of 14 seconds until the information in the data unit will be received and ready for display. This time may be recalculated as transmission/reception of the uplink telemetry data proceeds.

Receiver 40 may include one or more data processors 44 which execute software programs 46 to perform these steps. In addition or in the alternative, receiver 40 may include hard-wired logic and/or configurable logic circuits (e.g. FPGAs) which perform some or all of the data processing steps.

In some embodiments, receiver 40 is configured to monitor the rate at which data is being received from a downhole tool. Receiver 40 may also have stored in it a known sequence in which data is expected to be transmitted by the downhole tool. This known sequence may be established in any of a number of ways. For example:

- the sequence may originate at receiver 40 and be transmitted to the downhole tool in a suitable manner (e.g. by downlink telemetry);
- the sequence may be predefined (i.e. defined prior to deployment of the downhole tool) such that the same sequence is programmed into both the downhole tool and receiver 40;
- the sequence may originate from the downhole tool and may be communicated to receiver 40 by a suitable telemetry method (e.g. by MP or EM telemetry).

By knowing the sequence in which data is expected to be transmitted by the downhole tool and also the rate (e.g. frequency and cycles/bit) at which data is currently being received from the downhole tool, the surface telemetry receiver 40 can determine information about the data such as what data is expected to be transmitted next from the downhole tool, when the next update of any particular information is expected, and so on. Based on this information, data processor 44 of surface telemetry receiver 40 may be configured to display on display 30 one or more of:

- a text or graphic indication of the sequence in which the downhole tool is expected to send data;
- the amount of time expected to elapse before the next time certain data is updated;
- the next item of data that is expected to be updated;
- the time since one or more items of currently displayed data were last updated; and
- so on.

In some embodiments, certain data may be transmitted with different measures of precision and/or different measures of reliability. As an example of different measures of precision, certain data may be transmitted sometimes using a smaller number of bits and at other times using a larger number of bits. For example, a certain value may be transmitted using 8 bits but every so often the same value may be transmitted using 12 to 16 bits.

As an example of data received with different levels of reliability, certain data may be transmitted in a format such that the data is transmitted first and a check value (e.g. a parity bit, a checksum, or the like) is transmitted second. Receiver 40 may display the data as soon as it has been received with an indication that the data is not completely trustworthy (e.g. because it has not yet been compared to the check value). After the check value has been received and compared to the received data, receiver 40 may update the indicator to show that the data is trustworthy if the check value matches the received data. If the check value does not match the received data, receiver 40 may take one of various actions such as displaying previously received data together with an indication that the previously received data is old or displaying a value extrapolated from previously received data together with an indication that the displayed data is not actual received data. In these or other embodiments the display may change appearance to indicate reliability of the data such as by displaying the data in a different colour (e.g. green for reliable, yellow for somewhat reliable, and red for unreliable).

In some embodiments, receiver 40 may generate an initial indication of reliability which depends on an error rate measured for previous recent uplink data transmissions. In cases where the error rate has been very low, a higher measure of reliability may initially be indicated than in cases where recent transmissions have been affected by a higher error rate (as indicated, for example, by mismatches between transmitted data and parity bits or checksum values).

In some embodiments, receiver 40 may generate an indication of reliability based on analysis of received signals. For example, receiver 40 may generate a confidence metric based on one or more of:

- the decoder constellation's position within a timing window for mud pulse transmissions,
- amplitude variations in the received signal,
- clustering of the constellation for quadrature phase-shift keying (QPSK) encoded signals, and/or
- signal-to-noise ratio.

Receiver 40 may also or in the alternative compute and display an indication of another reliability indicator based on previous values of a parameter. For example, certain parameters may be expected to change only relatively slowly. If the current value received for such a parameter exhibits a sudden jump from a previous value (or average or trend of previous values) then the current value for the parameter may be suspected to be unreliable. In an example embodiment, receiver 40 compares received values for parameters to previously received values for the same parameters (or to values computed from the previously received values) and, based on the comparison, generates and displays an indication that the current value is reliable or unreliable (in some embodiments, the indication is displayed only if the current value is unreliable or only if the current value is deemed reliable).

In some embodiments, receiver 40 determines a combination of two or more of the above reliability indicators and uses that combination to:

control whether or not certain received data is displayed;

indicate on a display a level of reliability of items of received data;

trigger changes in data transmission protocols; and/or trigger changes in the sequence of data items being transmitted.

In some embodiments, receiver 40 monitors how long it has been since certain displayed data was last updated and generates a measure of reliability that generally declines over time. Reliability measures for different values may decline at different rates. The rates of decline of reliability measures for different values may be based on the relative importance of those values. For example, an operator may specify that the rate of decline in reliability for azimuth measurements is high (i.e. azimuth is of relatively high importance) while the rate of decline for temperature measurements is low (i.e. temperature is of relatively low importance). In some embodiments, the rate of decline may depend on a state of drilling operations. For example, where a value indicates a directional heading (e.g. a compass bearing) at a downhole tool the rate of decline of reliability may be greater where the drill string is being turned at the surface or while active drilling is proceeding than would be the case where the drill string has been quiet since the directional heading was last updated.

For example, in some embodiments, the reliability measure may be given by the formula $$R(t)=e^{-\sigma t} \tag{1}$$

where R(t) is the value of the reliability measure at a time t, and σ is a decay constant which may depend on the particular value being measured. For example, more important values and/or values that are expected to change relatively rapidly with time may be assigned a larger decay constant (such that the reliability measure decays more quickly), while less important values and/or values that tend to vary relatively slowly with time may be assigned a smaller decay constant (such that the reliability measure decays more slowly). In some embodiments decay constants for one or more variables may be set based on a mode of a drilling operation.

In some embodiments, receiver 40 discontinues display of data in the event that:

more than a threshold time has elapsed since the data was received; and/or the reliability of the data is lower than a threshold reliability value.

In such embodiments, the threshold times and the threshold reliability values may optionally differ for different data items. In such embodiments, the threshold times and/or threshold reliability values may optionally be user set.

In some embodiments, the measure of reliability may be calculated and/or displayed in relation to an angle of drilling, heading, and precision. In some embodiments, the measure of reliability is based in part on one or more of the angle of drilling, heading, and precision.

In some embodiments, related data may be displayed in groups (i.e. proximate to one another, or under a common heading). For example, downhole values such as torque and EM current may be grouped together under one heading and uphole values such as signal-to-noise ratios and signal strength may be grouped together under another heading.

In some embodiments, receiver 40 may flag displayed values if critical values are achieved. For example, if the azimuth measures greater or less than a threshold range, the operator may be alerted.

Figure 5:
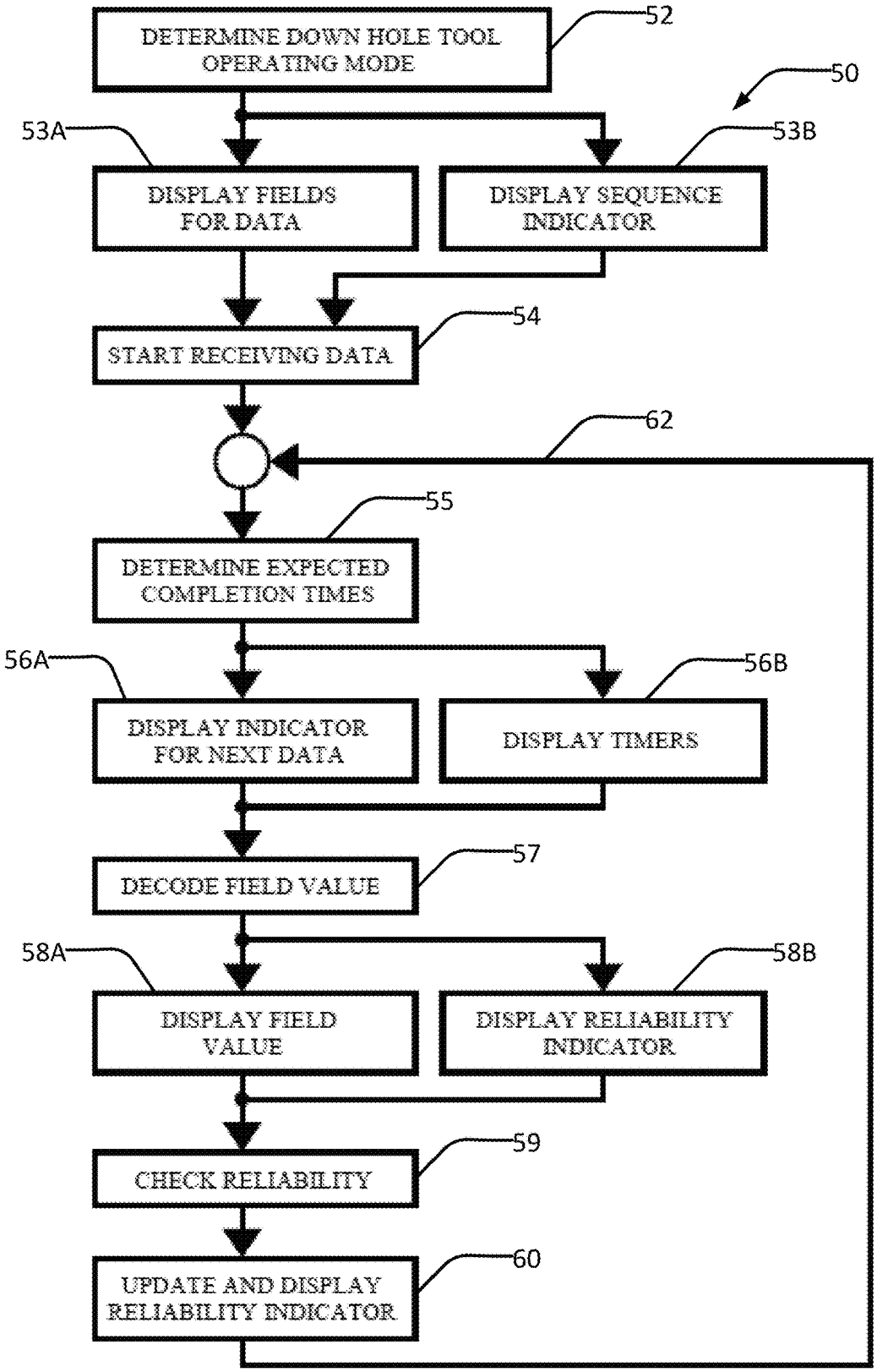
FIG. 5 is a flow chart illustrating a method according to an example embodiment.

FIG. 5 is a flow chart which illustrates an example method 50 according to one aspect of the invention. Method 50 may be performed at a surface receiver of telemetry signals. In certain embodiments, the telemetry signals are EM telemetry signals, although this is not mandatory. Method 50 may also or in the alternative be applied to telemetry signals of other types such as mud pulse telemetry signals.

In block 52, method 50 determines an operating mode of a downhole tool. A downhole tool may have different operating modes in which different selections of data are transmitted to the surface by telemetry. The operating modes may differ from one another in things such as which items of data are transmitted, the order in which the items of data are transmitted, the precision of the transmitted items of data, and so on. Block 52 may involve any of:

receiving input from a user indicating which mode the downhole tool is operating in;

receiving a signal from the downhole tool which indicates a mode in which the downhole tool is operating;

recording a mode that the downhole tool has been commanded to operate in by surface equipment;

inferring an operating mode of a downhole equipment based on information about the drilling operation, such as a mode of the drilling operation;

etc.

In block 53A, fields for the data to be provided by the downhole tool in the operating mode are displayed on a display. In block 53B, a sequence indicator which indicates the sequence in which the operating mode will update the fields is also displayed on the display.

In block 54, method 50 commences receiving telemetry data from the downhole tool.

In block 55, method 50 determines expected completion times for the reception of data values to be displayed in the fields provided by block 53A. These expected completion times may be calculated based on the known sequence provided in the operating mode as well as the rate at which data is being received from the downhole tool. This rate may be measured by analyzing signals received from the downhole tool and/or may be predetermined based on the known mode of operation of the downhole tool. In block 56A, an indicator is provided to indicate which field is expected to be updated next. Block 56A may comprise inspecting the completion times to detect the earliest one of the completion times and displaying some sort of visual identification of the field corresponding to that data item. In block 56B, timers are displayed which indicate when the different displayed fields are expected to be updated. The timers may be countdown timers. Values in the timers may be obtained, for example, by subtracting a current time from the expected completion times.

In block 57, a value for a data item is decoded. A typical data item comprises multiple binary bits. Typically, the decoding of the data item occurs after all of the bits have been received. In block 58A, the field value is displayed. In block 58B, a reliability indicator is displayed. In some embodiments, block 58B may initially indicate that the displayed value is a preliminary value for which the reliability has not been assessed.

In block 59, the reliability of the displayed value is checked. Block 59 may include one or more of comparing a received parity or checksum value to the displayed value, comparing the displayed value to previously received values for the same field, monitoring a signal-to-noise ratio and monitoring a decoder confidence metric. Block 60 updates and displays the updated reliability indicator. Method 50 may repeat loop 62 until a new operational mode is selected for the downhole tool or transmission ceased in which case method 50 may terminate and restart at block 52.

Apparatus as described herein may also include functionality to assess the risk that data transmission using one or more telemetry modes may become unreliable or unavailable and/or risks that downhole apparatus may cease functioning or become damaged. Such risk indications may be based on: downhole sensor readings, other information regarding the drilling location (some of which may optionally be obtained by sensors at the surface equipment), past data regarding the performance of downhole tools and telemetry systems, and/or past data regarding the history of a particular tool.

A risk assessment system may take as inputs information such as:

- information about a particular downhole tool: e.g. model, age, elapsed time downhole, extremes of temperature, extremes of vibration, etc.;
- information about a power supply for the tool: e.g. battery model, age, elapsed time downhole, temperature extremes, vibration extremes, number of recharge cycles, state of health (SoH), etc.;
- information about the borehole being worked on: e.g. location, basin information; geographic depth, logging information (e.g. gamma, neutron, resistivity), etc.;
- information about environmental conditions of the tool: e.g. temperature, pressure, vibration levels, type of drilling fluid, etc.; and
- information regarding past outcomes for similar tools used in a similar operational environment.

Information about past outcomes for similar tools may be in the form of raw information or processed information. An example of raw information is a data set indicating when similar tools have failed previously and what conditions were the tools exposed to before they failed. Another example of raw information is a data set indicating depths at which certain data telemetry modes for similar tools have failed or become unreliable together with information regarding the geological circumstances in the boreholes in which these results were obtained.

An example of processed information is a formula (which may be based on raw information as described above) which yields as an output a prediction regarding a probability that a tool will fail in a particular time period as a function of some or all of the above information. Another example of processed information is a formula which yields as an output a prediction that electromagnetic telemetry will become unreliable at a certain depth as a function of some or all of the above information. Processed information may be generated in advance by performing a principal components analysis or a correlation analysis on raw data.

For example, the formula may be given by one of:

$$P(t) = 1 - e^{-bt^2} \tag{2}$$

$$P(t) = 1 - e^{-bt} \tag{2A}$$

$$P(t) = \frac{t}{t + A} \tag{2B}$$

$$P(t) = \left(\frac{\ln(t)}{\ln(t) + A}\right) \tag{2C}$$

$$P(t) = 1 - \frac{1}{t} \text{ for } t \geq 1 \tag{2D}$$

-continued $$P(t) = \tanh(ct) \tag{2E}$$

$$P(t) = Af_1(t) + Bf_2(t) \tag{2F}$$

Where:

P(t) in the range of 0 to 1 represents the probability that a tool will fail within a particular time t;

b, c, A and B are constants which may be set based on the type of tool (for example, based on data representing the past failure rate of the tool). In an example case b=½; and $f_1$ and $f_2$ are functions (such as for example the right hand side of any one of formulae 2 to 2E). $f_1$ and $f_2$ may respectively estimate short-term reliability of the tool and longer term reliability of the tool. In some embodiments $f_1$ represents short-term probability of failure and decreases with time and $f_2$ represents long term probability of failure and increases with time such that the overall probability curve has an inflection point.

A probability of failure may be based on factors other than time. Some examples of factors that may affect a probability of failure of a tool are one or more of: vibration levels to which the tool has been exposed, shocks to which the tool has been exposed, temperatures to which the tool has been exposed, hours of operation of the tool, battery power levels to which the tool has been exposed, output power levels at which the tool has been operated, etc. In some embodiments probability of failure takes into account time in combination with one or more other factors such as the above. As a simple example of one way to achieve this, the value tin any one of formulas 2 to 2F could be replaced by a sum of terms in which each term represents a measure of a factor which may contribute to the probability of failure of the tool. Each factor may be weighted by a constant or function.

A prediction of the risk that a tool will fail may be based entirely or in part on the performance of the tool. For example, a record of the strength of EM telemetry signals emitted by a tool may give an early indication of an increased risk of tool failure. For example, decreased electrical isolation between output terminals of an EM telemetry transmitter may result in reduced signal being delivered into surrounding formations for a given output power level. The electrical isolation may be tested directly at surface or downhole. The electrical isolation may also be inferred from the performance of the tool while the tool is in use (e.g. by measuring the strength of a signal received at a receiver as a function of depth of the tool in a formation having known properties, frequency, and transmit power level). In any case, an estimate of the electrical isolation may be included in a formula for estimating probability of failure of the tool (e.g. such that as electrical isolation becomes worse the predicted probability of failure of the tool is increased). A predictive mathematical formula may be used to determine a risk of failure of a tool based on input information regarding received EM telemetry signals. In an example embodiment, the input may include EM signal received as a function of frequency and information characterizing a formation (e.g. a resistivity log). For example, the formula may be one of Formulas 2 to 2E above, with t replaced by a function of x(f, d, P) which represents the EM signal received as a function of frequency, depth of the tool and transmit power level. For example, the function may compare x(f, d, P) to X(f, d, P) where X(f, d, P) is the signal that would be expected if the tool were in perfect condition. Alternatively, the EM signal received as a function of frequency, depth of the tool and transmit power level may be factored into one or more of the constants in one of formulas 2 to 2F above. For example as x(f, d, P) falls in relation to X(f, d, P) a constant that controls how fast probability of failure P(x) increases with time may cause P(x) to increase faster with time. For example the constant b in formula 2 or 2A may be increased as x(f, d, P) falls in relation to X(f, d, P). Since a received signal level may vary for reasons other than degradation of a tool, x(f, d, P) may be a time average.

Consider the case of a hypothetical example downhole tool. Many downhole tools of the same model have been used in past drilling operations. Some of these were run until they failed. Others have not yet failed. Logs of the environmental conditions to which each of the downhole tools have been exposed are stored in a data set. By processing the data from the data set, one might determine the average time to failure for this type of downhole tool together with factors that tend to result in early failures and other factors that tend to result in longer than average operational life. In this hypothetical example case, it is found that the risk that the downhole tool will fail in the next N hours of drilling is given by a function which increases with some combination of:

- the age of the tool (since manufacture);
- the number of hours the tool has been in use;
- the mean square vibration level to which the tool has been exposed while in use;
- the maximum downhole pressure to which the tool has been exposed;
- the number of hours that the tool has been in use in water-based drilling fluid;
- the number of hours that the tool has been in use at a temperature above a threshold temperature times the maximum temperature during those hours;
- measured temperature exposures of one or more selected components (e.g. batteries, sensors, processors); the temperature exposures may comprise, for example, one or more of: maximum temperatures, operating times above one or more threshold temperatures, and standby times above one or more threshold temperatures;
- the mean square value of the product of pressure and vibration level while the tool was in use;
- battery cell strain;
- battery cell health;
- cumulative energy of shocks applied to the tool;
- number of maintenance services the tool has required;
- replacement parts history;
- severity of issues that have necessitated maintenance services of the tool;
- preventative maintenance history for the tool;
- etc.

These findings may be reduced to a formula which takes as input information regarding the past exposure of the downhole tool to various environmental factors and produces a risk value as an output.

For example, in a simple example embodiment, the formula may be given by $$P(a, h, t) = \frac{Aa + Bh + Ct}{Aa + Bh + Ct + D} \tag{3}$$

where P(a, h, t) represents the probability or risk of failure, a represents the age of the tool, h represents the number of hours the tool has been in use, t represents the temperature exposure of the tool, and A, B, C, and D are constants. Additional or alternative parameters as described above may be used in Formula 3. Formula 3 is similar to formula 2B. Other examples may be created by replacing t with a sum of factors such as Aa+Bh+Ct in another one of formulas 2 to 2F or another formula which trends toward higher probability of failure as its argument increases.

Figure 6:
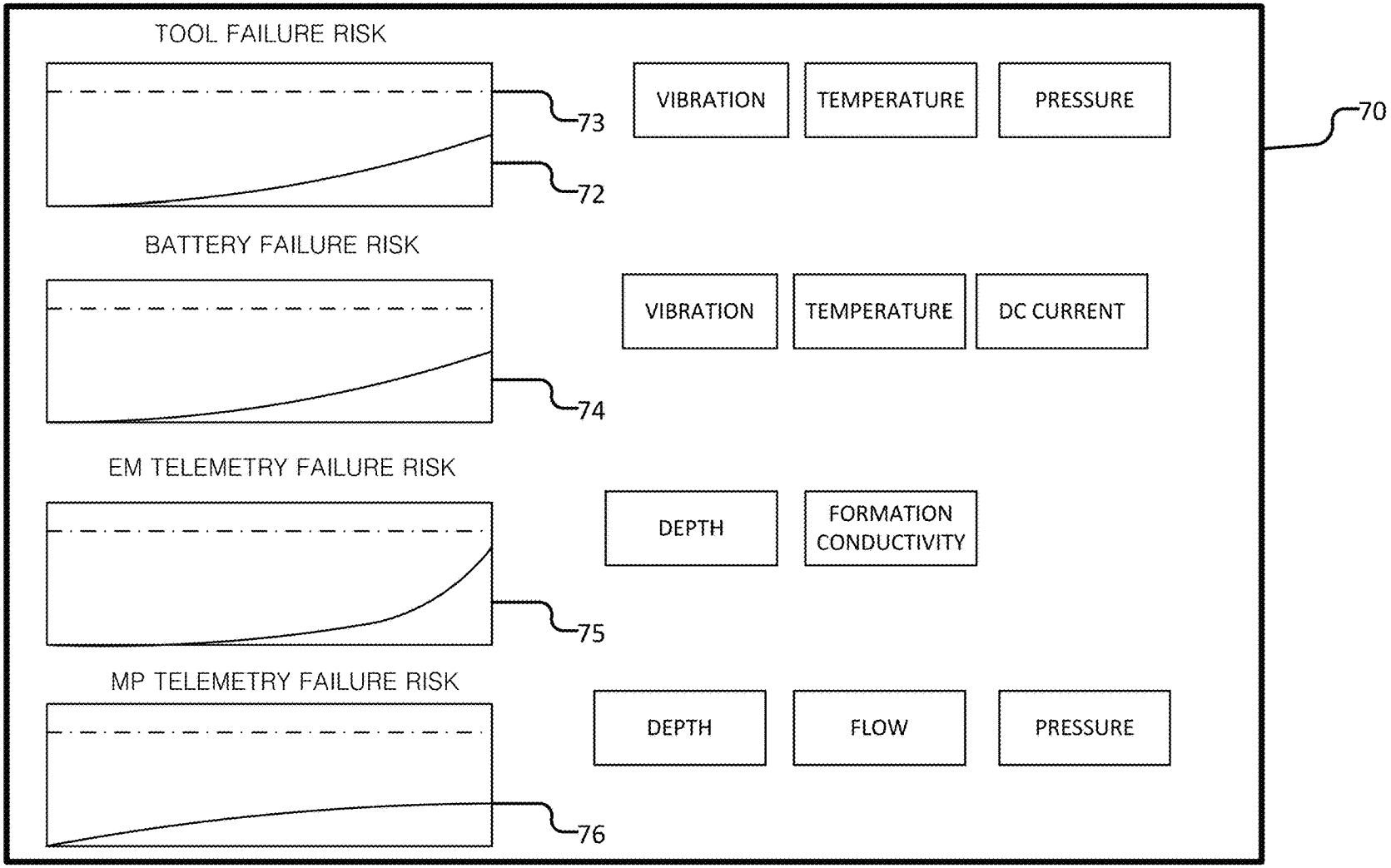
FIG. 6 is an example display that includes outputs from a risk assessment system, according to an example embodiment.

FIG. 6 shows an example display 70 that includes outputs from a risk assessment system. Display 70 includes an indicator 72 showing a calculated risk that a downhole tool will fail. In the illustrated embodiment, indicator 72 includes a time series (expressed, for example as a graph, bar chart, or the like) which illustrates how the risk of failure of the downhole tool is evolving. Indicator 72 may include threshold lines 73 which indicate risk levels at which the operator should take action to mitigate the risk according to policies applicable to the drilling operation. An example of risk mitigation strategy is to proactively replace a tool with a replacement tool before the tool fails. This replacement may be done, for example, when the drill string is tripped for another reason. In some embodiments, apparatus as described herein provides a status indicator that, when a risk of failure of a downhole tool (determined as described herein) exceeds a threshold level, the status indicator signals to an operator that the tool should be replaced.

In an example embodiment, a system as described herein may perform a test sequence on a tool. Such a test sequence may be initiated manually or automatically. In some embodiments, the test sequence is initiated when the drill string is being tripped out. The test sequence may exercise the tool in a way intended to cause the tool to fail if the tool is prone to failure. Since the tool is being tripped out, the tool may be conveniently replaced if the test sequence causes the tools to fail. For an EM telemetry transmitter the test sequence may comprise, for example, EM telemetry signal transmissions at higher-than-normal power levels. Results of the test sequence may optionally be used together with other data as discussed elsewhere herein to estimate reliability of the tool.

Display 70 also includes an indicator 74 indicating the likelihood that a downhole battery power supply will fail and/or become discharged. In the illustrated embodiment, indicator 74 includes a time series which illustrates how the risk of failure of the downhole battery power supply is evolving. Display 70 may comprise indicators 75, 76 which each show calculated risks that a corresponding telemetry system will fail. For example, indicator 75 may indicate the level of risk that an electromagnetic (EM) telemetry system will become unreliable or stop working. Indicator 76 may indicate the level of risk that a mud pulse (MP) telemetry system will become unreliable or stop working.

Display 70 also displays, in proximity to some or all of indicators 72, 75, 76, indicators which display values for one or more parameters that are influential in establishing the risk. These parameters may be updated periodically. In updating the parameters, those parameters that have a higher impact on risk of failure may optionally be updated more frequently and/or in priority to other ones of the parameters.

A risk assessment system may calculate risks in real time based on the environmental conditions at a downhole tool and other relevant factors. Information regarding risks may be displayed to an operator. The risk information allows the operator to take action in advance to mitigate significant risks. For example:

- if the risk assessment system indicates that the risk that EM telemetry will become unreliable in the next 100 m (or some other distance) of drilling exceeds a threshold, the operator may switch the downhole tool to also or additionally use another kind of telemetry or may switch the downhole tool with another downhole tool the next time the drill string is tripped (e.g. to change the drill bit);

if the risk assessment system indicates that a risk of failure of the downhole tool exceeds a threshold, the operator may arrange to have a replacement downhole tool on standby and/or may replace the downhole tool with another downhole tool the next time the drill string is tripped and/or may modify drilling operations to reduce or avoid conditions that could expedite failure of the downhole tool (for example, drilling operations may be modified to reduce a vibration level at the downhole tool);

if the risk assessment system indicates that a risk of failure of batteries for the downhole tool exceeds a threshold, the operator may take steps to conserve electrical power and/or take steps to transmit required information to uphole systems early and/or shut down the tool and/or may arrange to have replacement batteries available and/or may change the batteries the next time the drill string is tripped.

The risk assessment system may retain a log of conditions endured by the downhole tool and the condition of the downhole tool. Information from the log may be added to the dataset which contains information of the past performance of downhole tools.

The risk assessment system may comprise a software process executing on a data processor. In some embodiments, the data processor is a processor of surface equipment that includes a telemetry receiver and decoder and a display. In some embodiments, the data processor is provided by a cloud computing environment.

Risk assessments may be based on the specific composition of a downhole tool. For example, a downhole tool is typically made up of a number of subassemblies. From time to time different versions of any of the subassemblies may be created. Different otherwise similar downhole tools may differ from one another based on the versions of the subassemblies that they are made up of. Different otherwise similar tools may also differ from one another by including or not including optional subassemblies.

The risk of failure of a particular tool can be influenced by the particular subassemblies that the tool includes. For example, an early version of a particular subassembly may have a higher risk of failure than a later version of the subassembly that has been redesigned to make it more reliable. Different versions of a subassembly may be affected differently by environmental conditions (for example, certain components of one version of a subassembly may have a higher temperature ratings than corresponding components in a different version of the subassembly and/or certain versions of a subassembly may be more affected by shocks and vibrations than other versions of the same subassembly).

Some embodiments apply stored information regarding the risk of failure of individual subassemblies in a tool to compute an overall risk of failure for the tool. This information may be a simple overall metric such as a mean time between failures ("MTBF") for different versions of the subassemblies that may be included in a tool or may include more detailed information (such as any of the information described elsewhere herein) that describes the risk of failure for each version of each subassembly. This information may include, for example, how each version of each subassembly responds to environmental factors such as temperature, vibration, shock, operation at different power levels, standby time, aging, etc. For example, the MTBF metric for a particular tool or subassembly may be given by a measure of the total time the tool or subassembly has been operational divided by the number of failures experienced by the tool or subassembly. An example of such a metric is:

$$MTBF = \frac{\Sigma(SDT - SUT)}{NF} \tag{4}$$

where SDT is the start of a "downtime" period (a period of time where the tool or subassembly has failed and is not operational), SUT is the start of an immediately preceding "uptime" period (a period of time where the tool or subassembly is operational), and NF is the number of failures of the tool or subassembly.

Estimating risk of failure of a tool based on failure information for the specific versions of different subassemblies which make up the tool may provide more reliable estimates of tool reliability than using failure information for a population of tools that does not take into account the specific makeup of each tool. The failure information may be based, for example, on statistics acquired from use of each version of each subassembly in the field and/or tests performed on samples of the subassemblies and/or modelling possible failure modes of the subassemblies.

In some cases the makeup of a tool may change over time, e.g. as a result of the replacement of certain subassemblies for purposes of upgrade or repair. Some embodiments separately log historical information for some or all subassemblies of a downhole tool. This historical information may be used (on its own or together with other information regarding the reliability of the subassemblies) to assess a risk of failure for the tool.

Combining the risks of failure of individual subassemblies of a tool to assess a risk of failure of the tool may depend on the role that each subassembly plays in the tool. If failure of any subassembly will result in the failure of the tool then the risk of failure of the tool may be obtained by combining (e.g. by adding) the risk of failure of each subassembly in the tool. Where two or more subassemblies are redundant then the risk of failure of the tool may depend on the risk that all of the redundant subassemblies will fail at the same time. A system as described herein may store an algorithm for computing failure risk for a tool given as input failure risks for the individual subassemblies that make up the tool.

Information about the risk of failure for a tool may be applied to facilitate decisions regarding use of the tool in the field as described above. In embodiments where risk of failure is determined at a subassembly or component level (such that different individual tools of the same type may have different risks of failure) another application of the present technology is to grade or select or sort individual tools (which may be new, never used tools or previously-used tools) based on the different estimated risks of failure for the tools.

Where a tool includes a subassembly or component that has been previously used, then the estimated reliability of the tool may be determined based in part on information (as described elsewhere herein) that describes the conditions of the previous use. Information specific to individual tools that indicates the risk of failure of the tool may be applied to allow tools that are expected to be more reliable (for example because they are built with more reliable versions of critical subassemblies) to be selectively directed to certain end uses.

For example:

- a most reliable tool may be selected to be sent for use at a remote or difficult to access location while tools that are less reliable than the most reliable tool may be selected for other jobs;
- a most reliable tool may be selected to be delivered to a very important customer;
- a most reliable tool may be sold or rented for a premium price;
- a most reliable tool may be selected for use in a particularly critical, demanding, or high value application; or
- tools of normal reliability may be directed to less-critical applications.

Access to a computer system as described herein that automatically determines reliability metrics (risks of failure) for individual tools facilitates the above selections. In some embodiments, the computer system comprises or is connected to receive data from an engineering change management system and/or a maintenance management system which processes tickets for repairs to tools or components of tools. Data from such systems may be used to refine estimates of the reliability of tools and their subassemblies and components.

Data from an engineering change management system may be used to evaluate the reliability of different components or subassemblies. The number of tickets recorded in an engineering change management system that report problems with and/or request design changes for a particular version of a component or subassembly is one measure of reliability. A component or subassembly for which there are no or very few such tickets may be considered to be more reliable than a version of a component or subassembly for which there are more tickets. Where such tickets are associated in the engineering change management system with a severity level, the severity level may also be taken into consideration. Data from an engineering change management system may be used on its own or together with other relevant information as described herein to assess the reliability of different versions of components or subassemblies generally or individually.

In some embodiments, different versions of a subassembly or component may be given a score relating to the reliability of the subassembly or component. This score may be determined based on data from an engineering change management system which may include numbers and severity of tickets, technical alerts, and the like, as well as other information based on experience with different versions of the subassembly or component in the field and/or engineering studies of the subassembly or component. Such scores may be used to compute reliability of a tool made up of any number of subassemblies and components. For example, the most recent version of any subassembly or component may be given a score of 100. Previous versions may be given lower scores with the scoring depending on the rate of occurrence and severity of problems affecting the previous versions. For example, in a particular case, "rev A" for a component may have a score of 10, "rev B" for the component may have a score of 40, and the current version of the component, "rev C", may have a score of 100.

A system according to an embodiment as described herein may track the versions of subassemblies included in individual tools, and may optionally include a set of rules for checking to ensure that the versions of subassemblies included in a tool are compatible with one another. The system may, for example, check for known incompatibilities between the versions of subassemblies recorded as being present in a particular tool.

A system according to an embodiment as described herein may track the versions of subassemblies included in individual tools and has access to data indicating the reliability of such subassemblies, and may be configured to identify tools for which a substantial improvement in reliability could be achieved by upgrading a small number of subassemblies. Such a system could be used to distinguish between tools in which many subassemblies contribute to a relatively low reliability and tools in which a few subassemblies are significantly less reliable than the rest of the tool (such that replacing a few subassemblies could very significantly improve the reliability of the tool).

In some embodiments, a system may track a number of tools each made up of a set of subassemblies having different use histories and versions. Such a system may be configured to automatically evaluate risk levels for the tools as described herein. The system may automatically identify tools having a risk level greater than a threshold. In response to determining that a tool has a risk of failure greater than the threshold, the system may automatically suggest improvements to the tool (e.g. replacing one or more subassemblies or components) that would cause the estimated risk of failure to be below the threshold (or another lower threshold).

The system may be configured to determine a lowest-cost way to improve the tool to have a risk of failure less than a threshold. The system may do this in a brute-force way (e.g. calculating what the risk of failure would be if one or more certain subassemblies were replaced with new and/or better-condition and/or updated versions of the subassemblies) or in a more sophisticated way (e.g. applying an algorithm that considers replacement of subassemblies most likely to result in achievement of a reliability improvement sufficient to satisfy the threshold at a lower cost than other possible replacements. For example, the algorithm may comprise computing any of the formulas described above, or a combination or variation of any of these.

A more sophisticated method may consider the reliability of the subassemblies currently in a tool and/or the cost for replacing different subassemblies and/or the current availability of replacement subassemblies in deciding what replacement scenarios to test for improved reliability. In some instances, tools may be scheduled for upgrades for other reasons (e.g. a recall or warranty-related upgrade or an upgrade to add a new capability that it has been decided to roll out to all tools). In such cases, the system may be configured to consider the effect on reliability of the scheduled upgrade.

A system that suggests improvements to tools may be used to proactively maintain a fleet of tools at a high reliability level and/or to suggested individualized upgrade paths for tools which take into account the most cost-effective ways to improve tools to have desired reliability levels. Even in a case where a tool is not below a threshold, such systems may optionally be configured to suggest upgrades to the subassemblies of the tool that would provide the highest return of improved reliability for a given level of investment.

Embodiments of the invention may be implemented using specifically designed hardware, configurable hardware, programmable data processors configured by the provision of software (which may optionally comprise "firmware") capable of executing on the data processors, special purpose computers or data processors that are specifically programmed, configured, or constructed to perform one or more steps in a method as explained in detail herein and/or combinations of two or more of these. Examples of specifically designed hardware are: logic circuits, application-specific integrated circuits ("ASICs"), large scale integrated circuits ("LSIs"), very large scale integrated circuits ("VLSIs"), and the like. Examples of configurable hardware are: one or more programmable logic devices such as programmable array logic ("PALs"), programmable logic arrays ("PLAs"), and field programmable gate arrays ("FPGAs")). Examples of programmable data processors are: microprocessors, digital signal processors ("DSPs"), embedded processors, graphics processors, math co-processors, general purpose computers, server computers, cloud computers, mainframe computers, computer workstations, and the like. For example, one or more data processors in a computer system for a device may implement methods as described herein by executing software instructions in a program memory accessible to the processors.

Methods as described herein may be performed using suitable hardware. Such hardware may comprise one physical device or a plurality of devices configured to work independently or collectively to receive and/or process telemetry data. In some embodiments, a controller implements the described methods. The controller may comprise any suitable device or combination of devices. In some embodiments each controller comprises one or more programmable devices such as one or more devices selected from: CPUs, data processors, embedded processors, digital signal processors, microprocessors, computers-on-a-chip, or the like. These programmable devices are configured by way of software and/or firmware to perform the required controller functions and are interfaced to other devices such as displays by way of suitable interfaces. In some embodiments two or more controllers may be implemented in software running on the same processor or set of processors. In addition or in the alternative to the use of programmable devices a controller may comprise logic circuits, which may be hard-wired, provided in custom IC chips, or the like and/or configurable logic such as field-programmable gate arrays (FPGAs).

Each controller may comprise one or more corresponding data stores. A data store may be separate or shared among two or more controllers. The data stores may comprise any suitable devices for storing data and/or software instructions. For example, the data stores may comprise memory chips, memory cards, read only memory (ROM), non-volatile memory, random access memory (RAM), solid-state memory, optical memory, magnetic memory or the like. The data store(s) may contain program code executable by the programmable device(s) to perform methods as described herein.

Processing may be centralized or distributed. Where processing is distributed, information including software and/or data may be kept centrally or distributed. Such information may be exchanged between different functional units by way of a communications network, such as a Local Area Network (LAN), Wide Area Network (WAN), or the Internet, wired or wireless data links, electromagnetic signals, or other data communication channel.

Embodiments of the invention may also be provided in the form of a program product. The program product may comprise any non-transitory medium which carries a set of computer-readable instructions which, when executed by a data processor, cause the data processor to execute a method of the invention. Program products according to the invention may be in any of a wide variety of forms. The program product may comprise, for example, non-transitory media such as magnetic data storage media including floppy diskettes, hard disk drives, optical data storage media including CD ROMs, DVDs, electronic data storage media including ROMs, flash RAM, EPROMs, hardwired or preprogrammed chips (e.g., EEPROM semiconductor chips), nanotechnology memory, or the like. The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Where a record, field, entry, and/or other element of a data structure is referred to above, unless otherwise indicated, such reference should be interpreted as including a plurality of records, fields, entries, and/or other elements, as appropriate. Such reference should also be interpreted as including a portion of one or more records, fields, entries, and/or other elements, as appropriate. For example, a plurality of "physical" records in a database (i.e. records encoded in the database's structure) may be regarded as one "logical" record for the purpose of the description above and the claims below, even if the plurality of physical records includes information which is excluded from the logical record.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof.

"herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A method for displaying data from downhole systems, the method comprising:

receiving data at a surface unit;

determining a downhole tool operating mode;

determining a plurality of display fields to be displayed based at least in part on the downhole tool operating mode, each display field representing one or more pieces of received data;

displaying the received data on the surface unit in corresponding display fields;

determining a plurality of expected completion times each of the expected completion times corresponding to one of the plurality of display fields and indicating when data required to update the corresponding display field is expected to have been received at the surface unit based on a rate of receiving the data at the surface unit; and displaying a next data indicator identifying a corresponding one of the plurality of display fields which will be updated next, the next data indicator based at least in part on the expected completion times.

2. A method according to claim 1 wherein determining a downhole tool operating mode comprises communicating with a downhole system.

3. A method according to claim 1 wherein determining a downhole tool operating mode comprises receiving user input.

4. A method according to claim 1 wherein the next data indicator comprises a countdown timer indicating when the corresponding display field will next be updated.

5. A method according to claim 1 wherein determining one or more of the expected completion times is based at least in part on a predetermined sequence of receiving data at the surface unit.

6. A method according to claim 5 wherein the surface unit and a downhole system are preprogrammed with the predetermined sequence.

7. A method according to claim 4 wherein the countdown timer is set based at least in part on the rate at which the received data is being received.

8. A method according to claim 1 comprising determining a reliability of a value in the received data corresponding to one of the display fields and displaying a reliability indicator corresponding to the one of the display fields.

9. A method according to claim 8 wherein displaying the reliability indicator comprises setting an appearance of the reliability indicator based at least in part on a comparison of the received data and a check value.

10. A method according to claim 8 wherein displaying the reliability indicator comprises setting an appearance of the reliability indicator based at least in part on a precision of the received data.

11. A method according to claim 8 comprising reducing the computed reliability as a function of time and updating the reliability indicator as the reliability is reduced.

12. A method according to claim 11 comprising suppressing display of the value if the reliability is below a reliability threshold level.

13. A method according to claim 1 comprising displaying a speed indicator representing the rate at which the received data is being received.

14. A method according to claim 1 wherein receiving data at the surface unit comprises decoding the data at the surface unit.

15. An apparatus for displaying data from downhole systems, the apparatus comprising:

a receiver for receiving downhole data;

a display for displaying the downhole data;

a first data field displayed on the display, the first data field based on at least a portion of the downhole data received by the receiver; and a first indicator on the display, the first indicator corresponding to the first data field and indicating when the first data field will next be updated, the first indicator based on a rate at which the downhole data is received by the receiver and on a predetermined sequence of data items included in the downhole data.

16. An apparatus according to claim 15 wherein the first indicator comprises a first timer, the first timer indicating when the first data field will be updated.

17. An apparatus according to claim 16 wherein the first timer is set based at least in part on the predetermined sequence of data items included in the downhole data.

18. An apparatus according to claim 17 wherein the display and a downhole system are preprogrammed with the predetermined sequence.

19. An apparatus according to claim 17 wherein the first timer is set based at least in part on the rate at which the downhole data is being received by the receiver.

20. An apparatus according to claim 15 comprising a first reliability indicator corresponding to the first display field.

21. An apparatus according to claim 20 wherein the apparatus is configured to set an appearance of the reliability indicator based at least in part on a comparison of a value of the first display field and a check value.

22. An apparatus according to claim 20 wherein the apparatus is configured to set an appearance of the reliability indicator based at least in part on a precision of the value of the first display field.

23. An apparatus according to claim 15 comprising a speed indicator representing the rate at which the downhole data is being received by the receiver.

24. An apparatus according to claim 15 comprising a decoder for decoding the downhole data after the downhole data is received by the receiver.

* * * * *